US005177884A

United States Patent [19]

Rullier

[11] Patent Number: 5,177,884

[45] Date of Patent: Jan. 12, 1993

[54] CROSS-COUNTRY SKI SHOE

[75] Inventor: Pierre Rullier, Annecy, France

[73] Assignee: Salomon S.A., Annecy Cedex, France

[21] Appl. No.: 814,059

[22] Filed: Dec. 26, 1991

Related U.S. Application Data

[63] Continuation of Ser. No. 578,208, Sep. 6, 1990, abandoned.

[30] Foreign Application Priority Data

Sep. 7, 1989 [FR] France ..... 89 11936

[51] Int. Cl.[5] ..... A43B 5/04; A43B 5/00; A43B 7/20

[52] U.S. Cl. ..... 36/117; 36/89; 36/114; 36/118

[58] Field of Search ..... 36/89, 109, 114, 117, 36/118, 119, 120, 121, 100, 101

[56] References Cited

U.S. PATENT DOCUMENTS

| | | | |
|---|---|---|---|
| 203,805 | 2/1966 | Werner et al. | 36/117 |
| 203,806 | 2/1966 | Werner et al. | 36/117 |
| 1,546,551 | 7/1925 | Petri | 36/89 |
| 1,610,700 | 12/1926 | Morton | 36/89 |
| 2,638,690 | 5/1953 | Bullard, III | 36/117 |
| 3,775,866 | 12/1973 | Marker | 36/117 |
| 3,775,872 | 12/1973 | Rathmell | 36/89 |
| 3,953,930 | 5/1976 | Ramer | 36/117 |
| 4,142,307 | 3/1979 | Martin | 36/117 |
| 4,505,056 | 3/1985 | Benéteau | 36/117 |
| 4,903,417 | 2/1990 | Senee | 36/117 |
| 4,991,319 | 2/1991 | Perner | 36/117 |
| 4,999,933 | 3/1991 | Balbinot | 36/117 |

FOREIGN PATENT DOCUMENTS

| | | | |
|---|---|---|---|
| 3004668 | 8/1981 | Fed. Rep. of Germany | 36/100 |
| 8807537 | 9/1988 | Fed. Rep. of Germany . | |

*Primary Examiner*—Paul T. Sewell
*Assistant Examiner*—Marie D. Patterson
*Attorney, Agent, or Firm*—Sandler Greenblum & Bernstein

[57] ABSTRACT

The invention concerns a sport shoe made of an upper with a heel cap, and including a rigid collar attached to the heel cap of the shoe and intended to surround the lower leg. According to the invention, the upper of the shoe is low, and the attachment of the rigid collar on the upper occurs at the upper end of the latter and essentially at the level of the malleolus.

20 Claims, 4 Drawing Sheets

CROSS-COUNTRY SKI SHOE

This application is a continuation-in-part of application Ser. No. 07/578,208, filed Sep. 6, 1990, now abandoned.

BACKGROUND OF THE INVENTION

1. Field of the Invention

The object of the present invention is a sport shoe for sports requiring a longitudinal mobility of the foot in relation to the leg and a good hold of the ankle, and is specifically adapted to walking (hiking, trekking) or cross-country skiing (but not ice skating).

2. Description of Background and Other Information

Such sports impose an effect on the shoe requiring front/back flexibility in the direction of displacement for extension/bending movements of the leg, and maximum rigidity in a perpendicular direction to the displacement for good ankle support.

German Utility Model G 88 07 537 proposes a cross-country ski boot more particularly adapted to the ice skating step.

This boot, represented in a side view of FIG. 1, is in fact a high shoe whose upper 1 extends above the malleolus of the user.

In order to provide strong lateral rigidity, this document proposes to join at 4, the heel cap 2 and a lower part of the upper a rigid collar 3 surrounding the top or rod 1*a* of the upper 1 and is provided with clamping devices 3*a* around the upper. Such a construction certainly permits some lateral support for the ankle of the user when executing ice skating steps, but on the contrary, allows only limited mobility in the longitudinal direction despite the rigid collar joint 3.

In effect, because this collar completely surrounds the top or rod 1*a* of the upper, pivoting forward or backward of the collar is limited by the inherent rigidity and the height of the <upper> itself, despite a certain suppleness of this <upper>.

As a consequence, in order to still permit a certain forward/back flexibility of the user's leg, the height of the upper 1 of such a boot must be limited, which is not compatible with a good lateral support of the leg. This known shoe upper thus hardly extends above the level of the malleolus, and the joint axis 4 of its collar 3 is low and definitely underneath the malleolus.

This kind of cross-country ski boot thus offers only minimal lateral support, because of its limited height, and only a reduced front/back mobility because of the presence of the upper interfering with the pivoting of the collar.

Mountain walking shoes for hiking or trekking traditionally have a high upper completely in leather.

Recently, research has been done to find lighter trekking shoes with leather uppers, or a strong fabric with leather reinforcements, or even all in plastic.

These different mountain shoes must all comply with the imperatives of strong support for the foot and ankle, notably for walking on rough or rocky terrains, and must also allow freedom of movement in the longitudinal direction for the foot in relation to the leg, in order not to interfere with the natural movement of the foot during walking.

Yet, present walking shoes with a high rigid upper, if they offer strong support for the foot, interfere with the natural movement of the foot during walking because the height and rigidity of the upper prevent much mobility in the longitudinal direction of the shoe.

SUMMARY OF THE INVENTION

The goal of the present invention is to remedy these drawbacks and to provide a sport shoe of the type cited above, thus allowing great a supple upper with a heel cap and a rigid collar joined on the heel cap of the shoe and intended to surround the lower leg, thus allowing great forward/backward flexibility while guaranteeing strong lateral support for the leg of the user.

This goal is achieved by the present invention by the fact that the upper of the shoe is low and the attachment of the rigid collar to the upper occurs at the upper end of the latter, this collar extending upward from the joint, beyond the upper edge of the upper. Such an arrangement in effect allows total independence for rotation of the collar in relation to the upper, and thus great freedom for forward/backward bending of the leg.

Also, this rotating freedom of the collar allows greater upward extension of the collar permitting better lateral support for the leg.

According to an advantageous form of construction, the attachment of the rigid collar on the upper occurs essentially at the level of the malleolus. As a result, the collar joint essentially corresponds to the natural joint of the leg and foot, and there is no difference between the axes of these joints.

In consequence, no relative displacement between the collar and the leg is produced during extension/-bending movements of the leg, and thus no uncomfortable rubbing. The user can also have a better fit of the collar on the leg, and thus a better hold of the ankle which is more comfortable.

BRIEF DESCRIPTION OF THE DRAWINGS

The above and additional objects, characteristics, and advantages of the present invention will become apparent in the following detailed description of preferred embodiments of several forms of construction applied to a cross-country ski boot of the skating type [A] and with reference to the accompanying drawings which are presented as non-limiting examples in which.

DETAILED DESCRIPTION OF PREFERRED EMBODIMENTS

Figure 2:
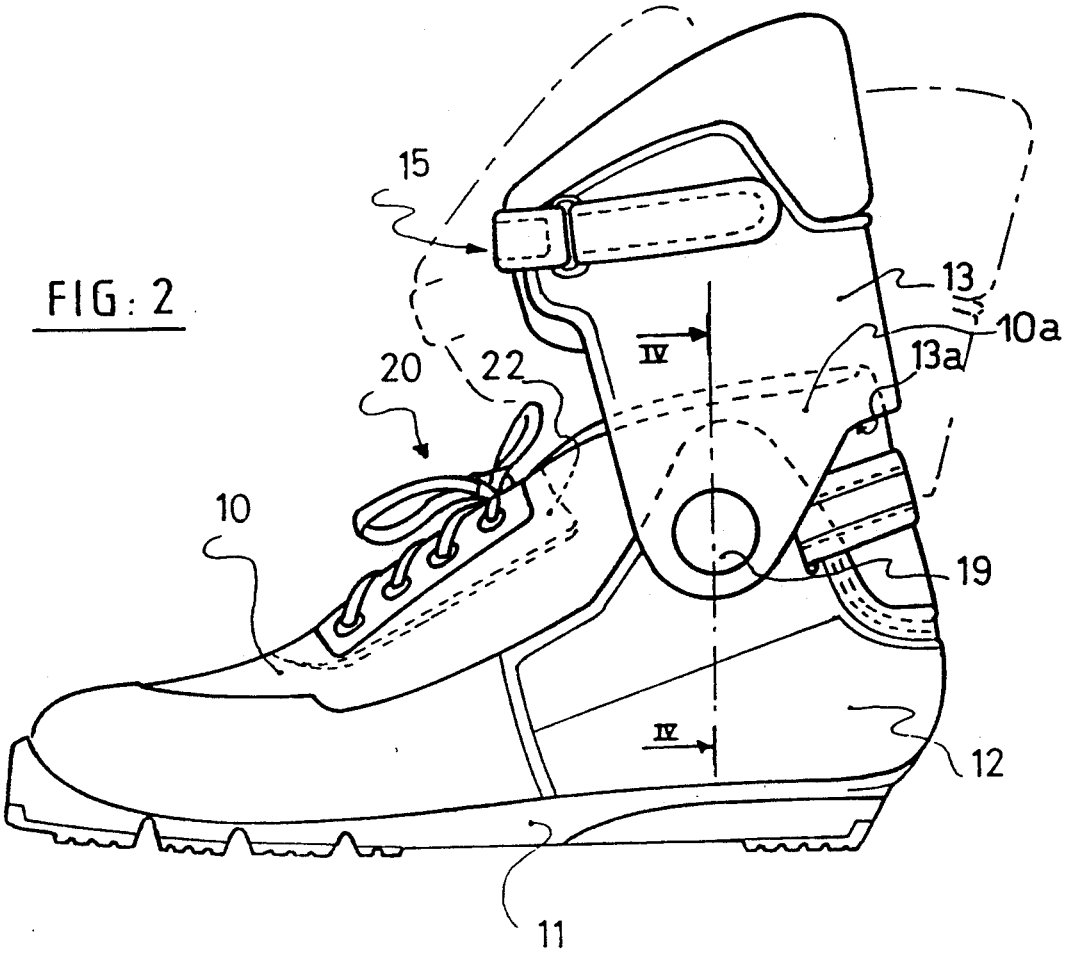
FIG. 2 is a side view of the present shoe according to the present invention.

The skating shoe represented in FIG. 2 looks like a normal low shoe from the outside, and is thus constituted of a low upper 10, that is, an upper whose rigid parts do not extend up beyond the malleolus, and an external sole 11 and a lacing system 20, which is already known.

The upper 10 is made of a supple material, and at the level of the heel, has a heel cap 12 which can be made in any way known in the art.

The heel cap 12 is preferably made of a rigid synthetic material, extending around the entire rear part of the shoe and the heel.

Figure 4:
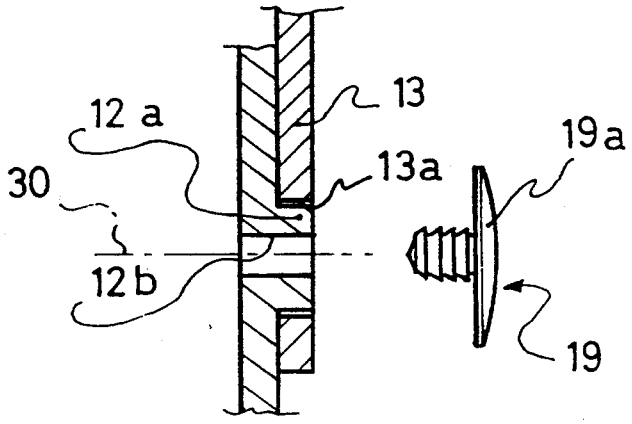
FIG. 4 is a partial section according to IV—IV of FIG. 2.

This cap 12 extends, in the zone of the malleolus, up to the top of the upper, to receive the jointed collar 13, and at its upper end, at the level of the malleolus on each side of the shoe, a projection 12*a* extends outward essentially perpendicular to the wall of the cap, to be introduced in the corresponding hole 13*a* provided in each side of the collar 13 (FIG. 4)

Each projection 12*a* has a hole 12*b* to attach the collar 13 with pins 19 (FIG. 4). With this arrangement, the collar 13 can thus be mounted on the projecting parts 12*a* of the cap of the upper at the upper end of the latter.

These pins 19, once engaged in the holes 12*b*, serve as a stop for the collar 13 while the projections 12*a* delimit the rotation axis 30 of this collar on the upper.

Note that the pins 19 can be replaced by any other linking method permitting rotation, such as rivets. However, using pins 19 is particularly advantageous because it permits installation by a simple application of pressure, without requiring another piece as in the case of rivets, which allows simplification especially of construction since the collar can then be installed during the final manufacturing phase of the shoe.

Also, the pins 19 may be advantageously made of a relatively supple material relative to a metal rivet, such as Delrin, so that their head 19*a* follows the potential deformations of the rigid collar 13; for example when the leg twists, such a construction prevents these pins from being pulled out.

The jointed collar 13 is made of a collar of a rigid material, and particularly of a synthetic material such as Pebax.

Figure 3:
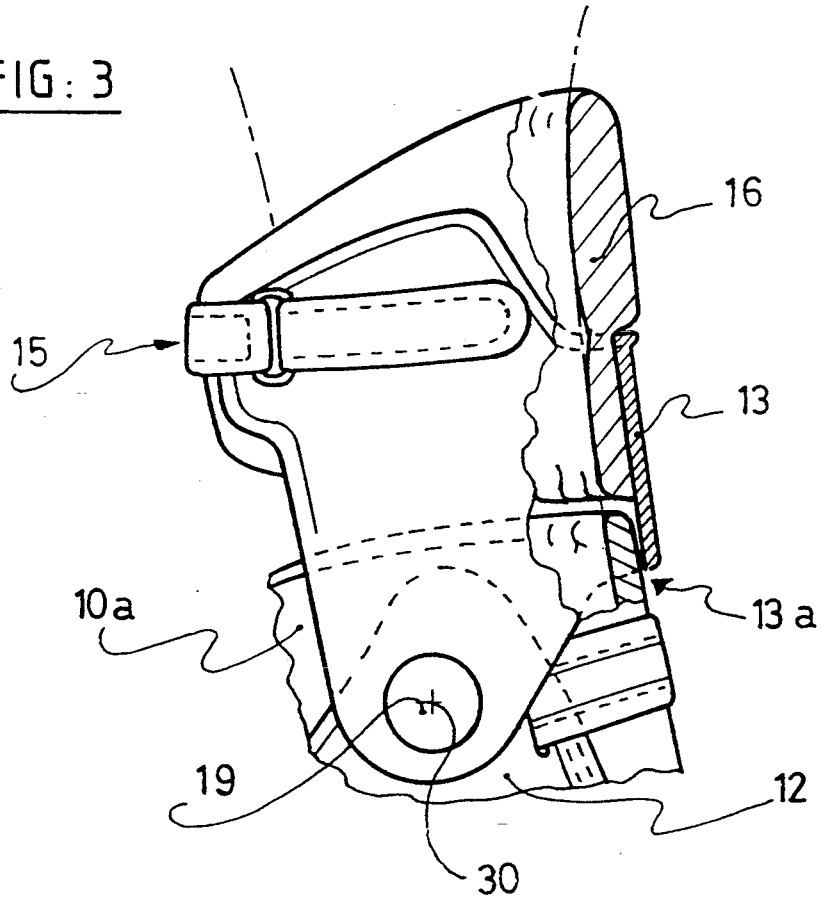
FIG. 3 is a partial lengthwise cross-section of a detail in FIG. 2.

The collar 13 extends upward to the bottom of the calf and surrounds the entire lower leg. It is open in the front to allow placement of the foot in the shoe, and is furnished with <fastening> devices 15 know in the art, and made, for example, of self-gripping devices (FIG. 3).

This collar 13 is also furnished with scalloping 13*a* at the rear intended to facilitate backward rotation of this collar (dotted line position in FIG. 2).

As easily imagined, the high height of the collar 13 allows excellent lateral support for the leg during skating. This height also permits a greater distribution of reaction stress on the leg, and in consequence, greater comfort for the user.

However, the height of collar 13 does not interfere with the forward/backward bending movements of the leg in relation to the foot, and can even be increased up to the middle of the leg in order to diminish the stress on the leg.

Figure 1:
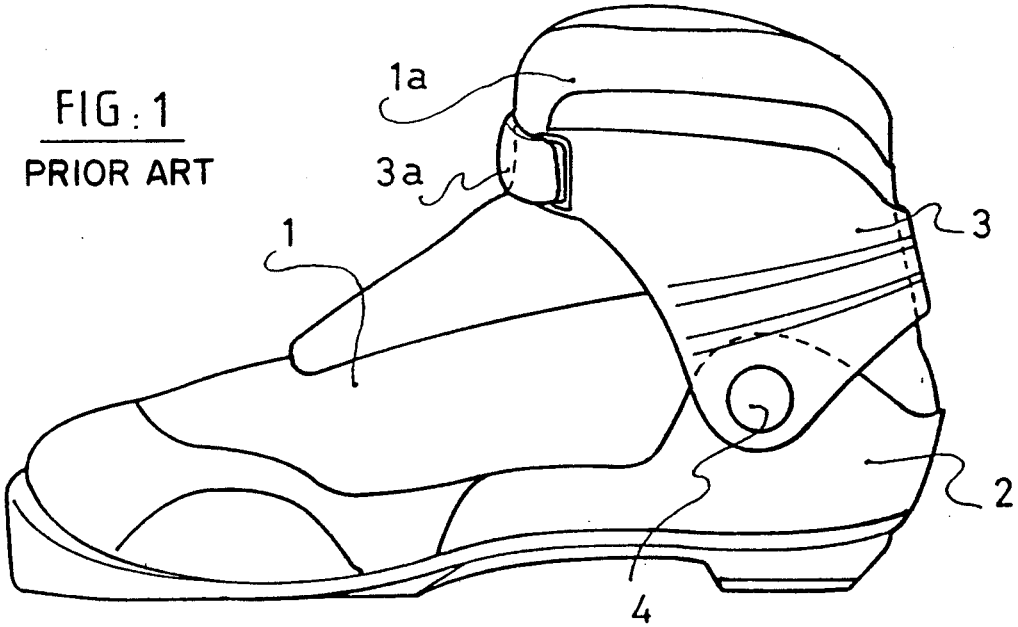
FIG: 1 PRIOR ART
FIG. 1 is a side view of a known cross-country shoe.

In effect, the complete, independent attachment of the collar 13 on the upper allows the collar to pivot freely without bothering the user, contrary to the shoe shown FIG. 1 and German G 88 07 537 cited above. Also, the tongue 22 as well as the lacing system 20, of the shoe does not extend above the bend of the user's foot in order not to interfere with its bending (FIG. 2).

The position of the articulation axis 30 of the collar 13 on the upper is selected in order to create the best compromise between comfort and an axis as close as possible to the natural position of the tibio-tarsal joint, as a function of the different sizes and shapes of the foot.

Figure 6:
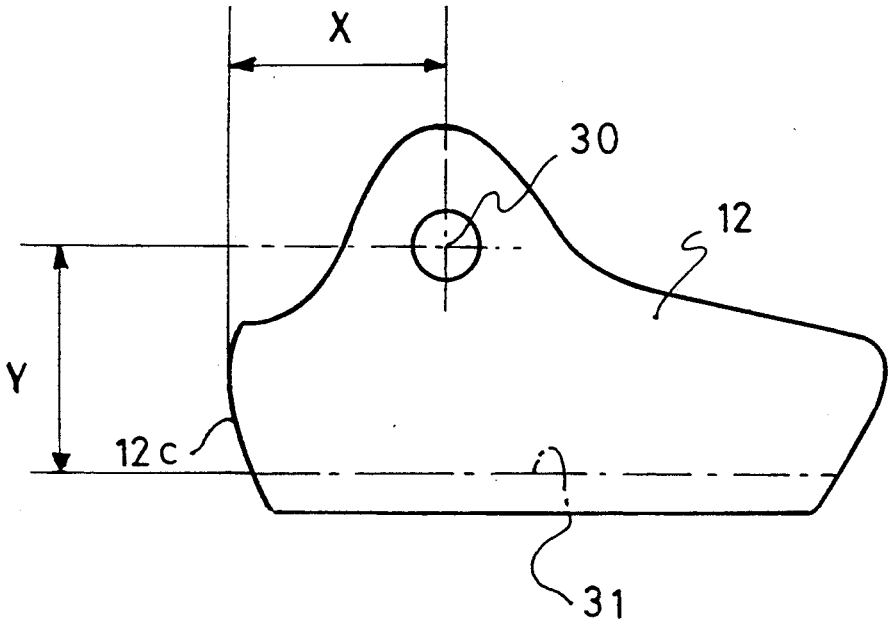
FIG. 6 is a diagram illustrating the position of the collar joint axis.

This articulation axis 30 positioned on each side of the heel caps 12, can be defined by the distances X, Y of this axis, in relation to the back of the heel cap 12*c* and above the <insole > 31, respectively (FIG. 6).

The optimal values of X and Y as a function of the different shoe sizes are given in the table below, with English shoe sizes (for an <insole> inside 4 mm thick).

| Distance in Millimeters | Shoe Size | | |
|---|---|---|---|
| | 2½ to 6 | 6½ to 9 | 9½ to 13 |
| X | 60 | 64 | 70 |
| Y | 50 | 56 | 60 |

The articulation axis 30 of the collar of the shoe, according to the invention, is essentially higher than the articulation axis 4 of known shoe collars (for size 8, the height Y of the articulation axis for this known shoe is equal to about 40 mm). As a result, the mobility of collar 13 is much greater and independent of the height of the upper, and the user's comfort is greatly increased, even more so because there is concordance between the articulation axis of the collar and the natural articulation axis of the foot.

As FIG. 3 shows, the collar 13 has an inside lining 16 for the comfort of the leg, which is interrupted in the zone 13*a* of the covering of the lower part of the collar 13 and the upper part 10*a* of the upper 10 to avoid any extra thickness in this area. Note that in the illustrated case, the part 10*a* of the upper extends slightly above the heel cap 12 and thus above the malleolus, but such a construction is not irritating because this part 10*a* is not rigid and is intended only for comfort. Such a part 10*a* thus does not interfere at all with the leg's bending and could even be eliminated.

Of course, the lining 16 is conceived in a way to extend continuously with the internal surface of the upper.

Figure 5:
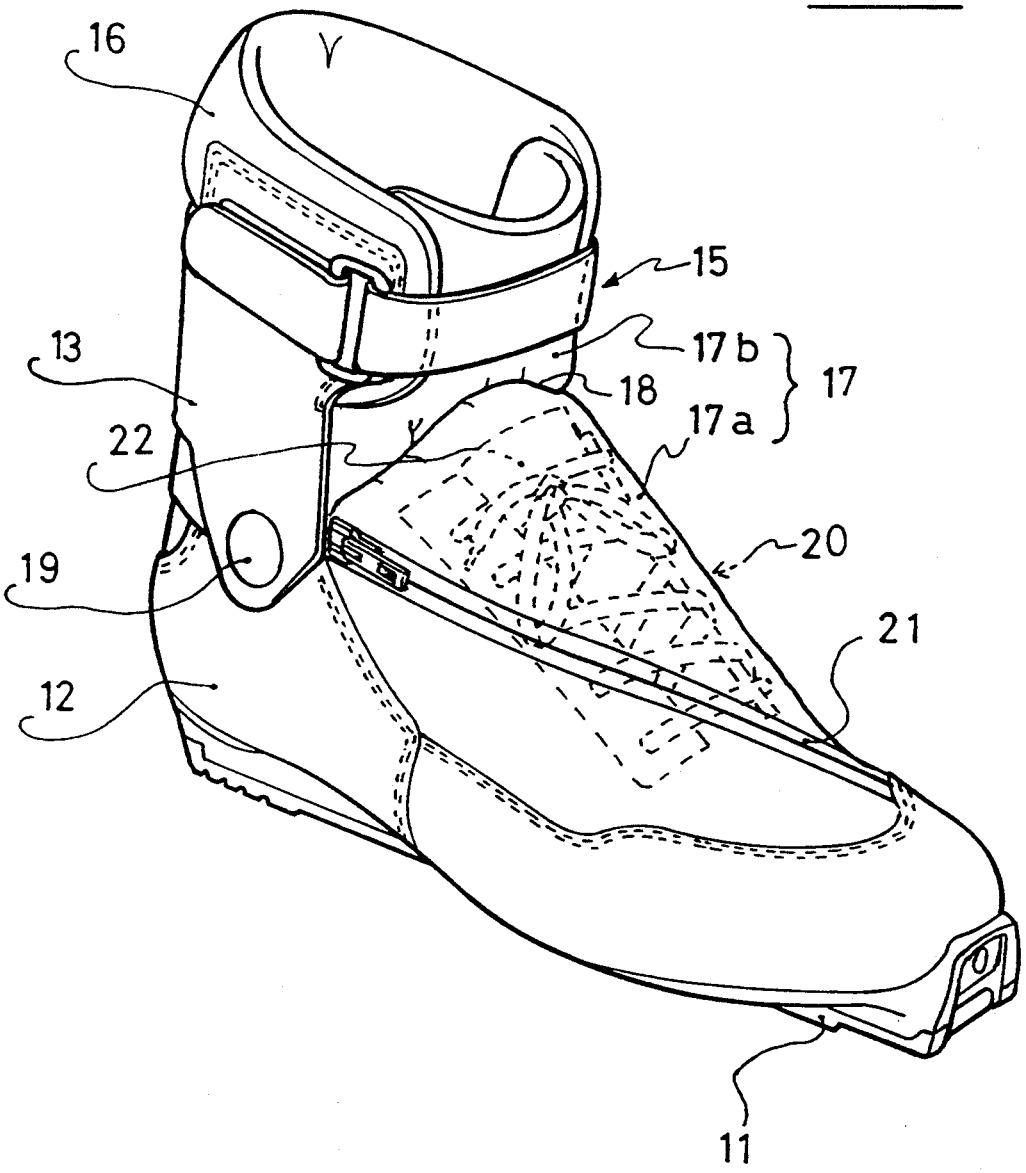
FIG. 5 is a perspective of the shoe according to another embodiment.

In FIG. 5, a shoe similar to that of FIG. 2 is illustrated, for which the same elements are designated by the same references.

The only difference between this shoe and that previously illustrated resides in the provision of a cover 17 designed to assure the water tightness of the shoe vis-a-vis the snow, without interfering with the rotational freedom of the collar 13 with respect to the upper.

As seen in FIG. 5, the cover 17 is made of two parts, 17*a*,17*b*, extending over the top of the <upper> and covering the lacing system and in front of the lower leg, respectively, to <close> the opening defined by the collar 13.

These two parts of the cover 17*a*, 17*b* are connected to each other by a seam 18 forming a hinge in order to preserve the flexibility of the show, the cover part 17*b* can pivot in relation to the lined part 17*a* integrated with the collar.

As seen in FIG. 5, the cover part 17*a* can, in a manner known in the art, open in two parts by means of a closure 21 like a zipper to allow access to the lacing system 20 of the shoe, which is an internal lacing system. As in the previously described embodiment, the tongue 22 does not extend beyond the bend in the foot of the user, in order not to interfere with the pivoting movement of the attached collar 13. The invention was described above in terms of cross-country ski boots, it can also be adapted for walking shoes.

In effect, it is sufficient to adapt to the uppers, described in connection with FIGS. 1–5, a walking sole in rubber or another material, to obtain an excellent walking shoe offering both strong ankle support and optimal mobility of the leg relative to the foot, for more user comfort.

In the case of such a walking shoe, the height of the articulation axis in relation to the upper surface of the sole will also be between 50 and 60 mm as a function of different shoe size.

On the contrary, the value indicated for distance in relation to the heel cap will be different as a function of the thickness of the latter or of the lining.

Of course, the present invention can also be applied to any sport requiring strong ankle support while allowing longitudinal lengthwise displacement of it relative to the foot.

Finally, although the invention has been described with reference of particular means, materials and embodiments, it is to be understood that the invention is not limited to the particulars disclosed and extends to all equivalents within the scope of the claims.

What is claimed is:

1. Sport shoe for walking and cross-country skiing, said shoe comprising an upper with a substantially rigid heel cap, said upper having an upper edge adjacent an upper edge of the heel cap, and including a substantially rigid collar attached at a joint to the heel cap of the shoe and designed to encircle the lower leg of a user, said joint allowing substantially free unconstrained pivotal movement of said collar in both forward and rearward direction with respect to said upper when encircling the lower leg of a user, wherein the upper edge of the heel cap is adjacent to the malleolus of a leg of a user, and in that the attachment of the rigid collar occurs at said upper end of the heel cap, said collar extending upward from the joint beyond an upper edge of the upper, said upper being formed from a substantially supple material the material being sufficiently supple so that the rolling of the foot during the cross-country walking movement will not be hindered.

2. Sport shoe according to claim 1, wherein the attachment of the rigid collar on the heel cap is essentially at the level of the tibio-tarsal joint of the leg and foot.

3. Sport shoe according to claim 2, wherein the height of the joint of the rigid collar, in relation to the insole is essentially between 50 and 60 mm.

4. Sport shoe according to claim 2, wherein, for a cross-country ski shoe, the distance of the joint of the rigid collar relative to the heel cap, is essentially between 60 and 70 mm.

5. Sport shoe according to claim 1, wherein the rigid collar extends upward approximately to the mid-leg of the user.

6. Sport shoe according to claim 1, wherein the rigid collar includes <fastening> devices around the leg of the user.

7. Sport shoe according to claim 1, wherein the collar includes a lining inside whose internal surface extends in continuity with an internal surface of the upper.

8. Sport shoe according to claim 7, wherein said lining is interrupted in the area of the lower part of said collar.

9. Sport shoe according to claim 1, wherein said upper is furnished with a tongue extending to the bend in the foot of the user.

10. Sport shoe according to claim 1, wherein the upper has a cover on its upper part to cover a <fastening> system of the shoe itself.

11. Sport shoe according to claim 10, wherein the cover has a supple extension extending upward to the same height as the collar and is designed to cover a front opening defined by this collar.

12. Sport shoe according to claim 11, wherein the extension is connected to the cover by a seam forming a hinge.

13. Sport shoe according to claim 1, wherein the collar is attached to the heel cap by two pins extending through said heel cap.

14. Sport shoe according to claim 13, wherein each pin is made of a synthetic material.

15. A sport shoe, for walking and cross-country skiing, said sport shoe comprising:

a) an upper being formed from a substantially supple material the material being sufficiently supple so that the rolling of the foot during the cross-country walking movement will not be hindered, and having an upper edge;

a substantially rigid heel cap having an upper end and an upper edge, said upper edge of said heel cap being adjacent to said upper edge of said upper and being adjacent to the malleolus of a leg of a user;

a substantially rigid collar designed to encircle the lower leg of a user and being pivotally attached to the upper end of said heel cap at a joint for allowing substantially free unconstrained pivotal movement of said collar in both forward and rearward directions with respect to said upper, when said collar encircles the lower leg of a user;

wherein said collar extends upwardly from said joint above the upper edge of said upper.

16. Sport shoe according to claim 15, wherein said joint is substantially at the level of the malleolus of the user.

17. Sport shoe according to claim 15, wherein said collar includes clamping devices for placement around the leg of a user.

18. Sport shoe according to claim 15, wherein said collar is pivotally attached to the heel cap by at least one pin extending through said heel cap.

19. Sport shoe according to claim 15, wherein said collar includes a lining, an internal surface of said lining extending in continuity with an internal surface of said upper.

20. Sport shoe according to claim 15, further including a cover on said upper.

* * * * *